US011719028B2

(12) United States Patent
Ackerman

(10) Patent No.: US 11,719,028 B2
(45) Date of Patent: Aug. 8, 2023

(54) DOOR JACK

(71) Applicant: Nikolas Ackerman, LaPorte, IN (US)

(72) Inventor: Nikolas Ackerman, LaPorte, IN (US)

( * ) Notice: Subject to any disclaimer, the term of this patent is extended or adjusted under 35 U.S.C. 154(b) by 294 days.

(21) Appl. No.: 17/104,232

(22) Filed: Nov. 25, 2020

(65) Prior Publication Data

US 2022/0162891 A1 May 26, 2022

(51) Int. Cl.
*E05C 19/18* (2006.01)

(52) U.S. Cl.
CPC ..... *E05C 19/188* (2013.01)

(58) Field of Classification Search
CPC .... E05C 19/003; E05C 19/005; E05C 19/007; E05C 19/18; E05C 19/184; E05C 19/188; Y10S 292/15; Y10T 292/1016; Y10T 16/4554; Y10T 16/473
See application file for complete search history.

(56) References Cited

U.S. PATENT DOCUMENTS 712,270 A * 10/1902 Dilthey ..... E05B 17/0025 292/65
758,942 A * 5/1904 Taylor ..... E05B 63/0017 292/DIG. 15
777,408 A * 12/1904 Fletcher ..... E05B 77/52 292/182
1,225,822 A * 5/1917 Kimball ..... B25B 23/0021 16/440

* cited by examiner

*Primary Examiner* — Christine M Mills
*Assistant Examiner* — Yahya Sidky
(74) *Attorney, Agent, or Firm* — Botkin & Hall, LLP

(57) ABSTRACT

A door locking device has a body with an overhanging ledge to mate with a bottom edge of a door. The body has a sliding member that is captured to the body and an eccentric cam with a faceted perimeter surface that rotates about an eccentric axis. When the eccentric cam rotates, the sliding member is moved from a retracted position toward an extended position. The sliding member has a foot portion that contacts a portion of the floor to lock the door by applying pressure between the floor and the bottom edge of the door. An arm is affixed to the eccentric cam and has a folding handle.

15 Claims, 8 Drawing Sheets

DOOR JACK

BACKGROUND OF THE INVENTION

This present disclosure relates to security devices for doors, gates, or other entry points with a moving component. Security and locking devices, whether permanent or temporary, have to be easy to use, easy to understand, and robust. Many have tried to solve this problem, such as U.S. Pat. No. 1,661,240, a device that uses a lever to flip an arm to a locked position. This requires the permanent affixation of two coupled components to a door. U.S. Pat. No. 5,269,573 discloses another device to be affixed to a door that uses rack and pinion gear sets, release levers, and also requires permanent affixation to a door. Others are temporary, like U.S. Pat. No. 7,017,959 that discloses a device that wedges between the side of the door and the door frame. Each of these devices suffer from not being easy to use, not being easy to understand, or not being robust enough to prevent unwanted intrusion. An improved device is needed.

SUMMARY OF THE INVENTION

The present disclosure describes a portable door lock that can be quickly implemented on a door to secure it from intruders. The device has a body that has a bottom ledge portion that catches the bottom surface of the door.

The device is for immobilizing a door, with the door having a bottom edge facing a floor. The device has a body with a channel for receiving and retaining a sliding member. The body has a door-facing surface that terminates at an overhanging ledge. The device has an eccentric cam having a geometric center. The eccentric cam is rotatably affixed to the body and rotatable about an eccentric axis that is offset from said geometric center. The eccentric cam has a plurality of surfaces defining a faceted perimeter. The surfaces are bounded by lateral edges with the lateral edges being radially farther from the geometric center than a portion of the surface located between adjacent lateral edges. The sliding member is retained in the channel and slidable between an extended position and a retracted position. The sliding member has a driven surface for facing and contacting the eccentric cam. The sliding member has a foot on an end opposite the driven surface. The device has an arm affixed to the eccentric cam to rotate the eccentric cam about the eccentric axis. The device has a spring biasing the driven surface of the sliding member towards the faceted perimeter of the eccentric cam. When the eccentric cam is rotated, the sliding member moves between said extended position and said retracted position. In the extended position, the device applies pressure between the bottom edge of the door and the floor to prevent the door from being moved.

DESCRIPTION OF THE PREFERRED EMBODIMENT

Figure 1:
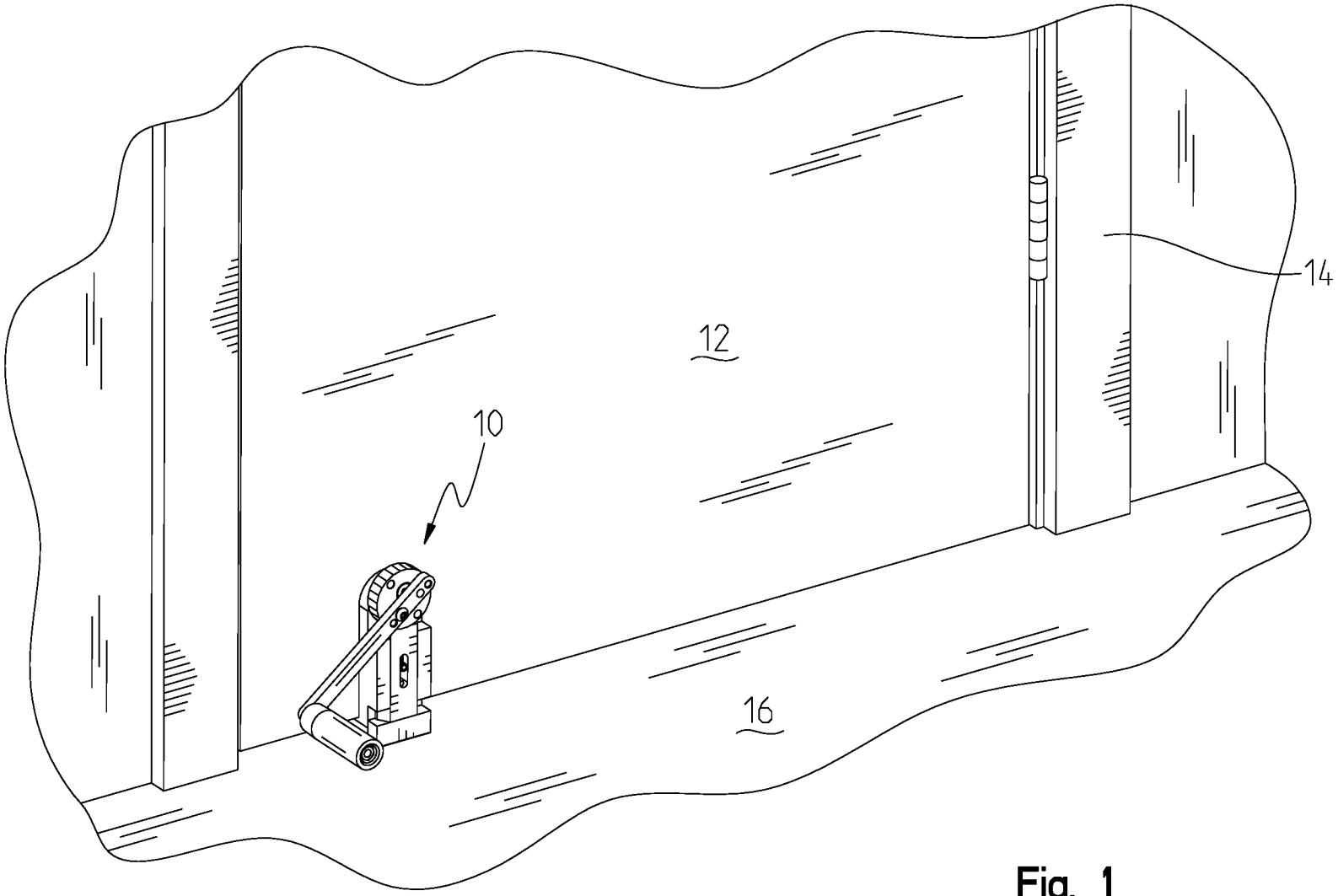
FIG. 1 is an isometric view of the device as installed on a door.

A locking device 10 is shown in FIG. 1 affixed to a door 12. As shown, the door 12 is hinged and connected to a frame 14. The door 12 has a bottom edge 13 that is located over a floor 16 and is spaced from the floor 16 by a gap 18.

The locking device 10 has a body 30 that retains a rotatable faceted eccentric cam 32 and a sliding member 34 affixed to a foot 36. An arm 38 is affixed to the eccentric cam 32 to rotate it about an eccentric axis 40. The body 30 has a bottom ledge portion 50 that protrudes from a door-facing surface 52. The body 30 also has a bottom surface 54 that extends to the bottom ledge portion 50. Opposite the door-facing surface 52 is a channel 56 that retains the sliding member 34. In the embodiment described herein, the channel 56 is trapezoidal or keystone shaped, but other shapes are contemplated. At the end of the body 30, opposite the bottom surface 54 is a top portion 58 which provides an attachment point 60 for the eccentric cam 32.

Figure 2:
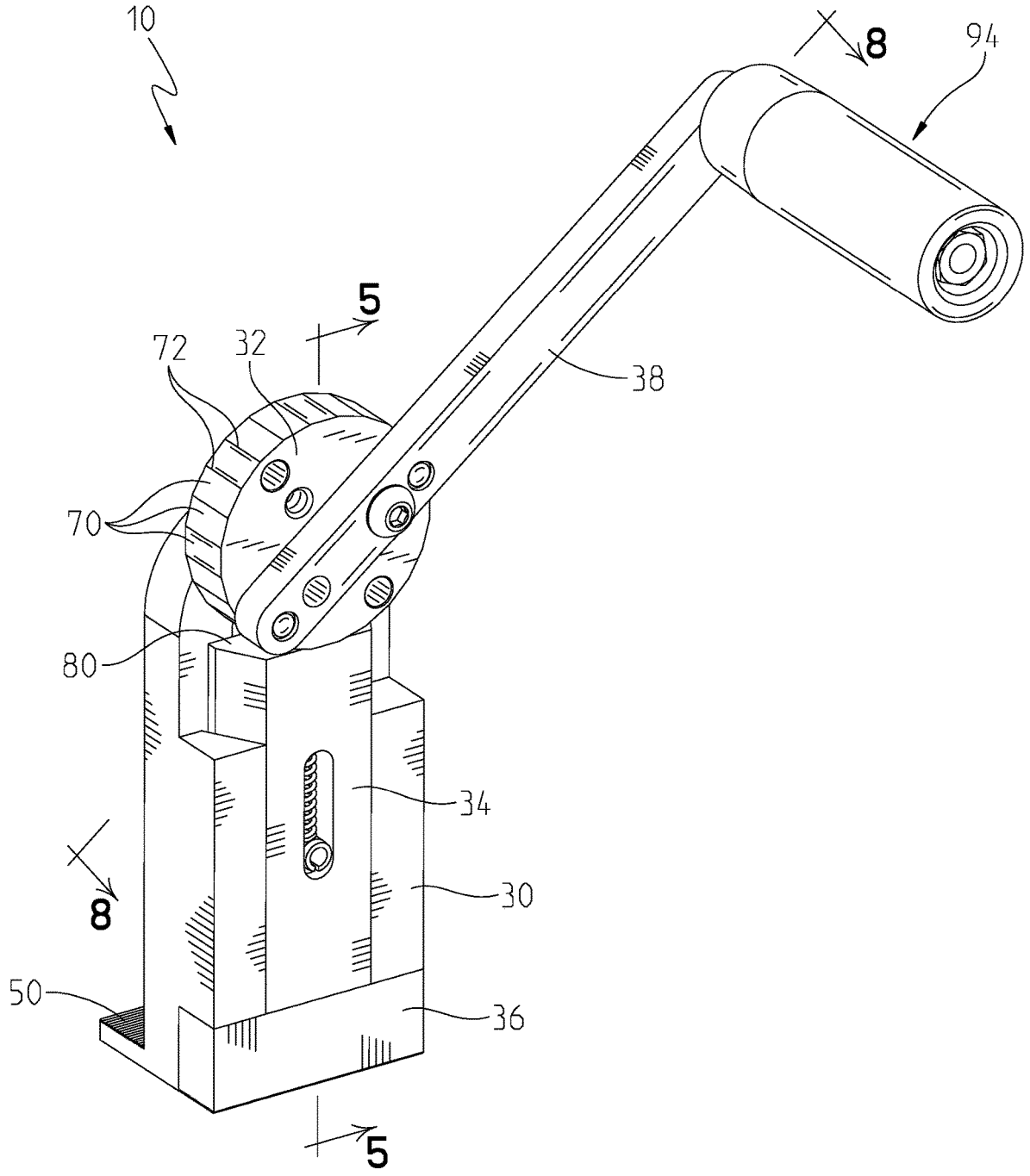
FIG. 2 is an isometric view of the device in the retracted position.
Figure 3:
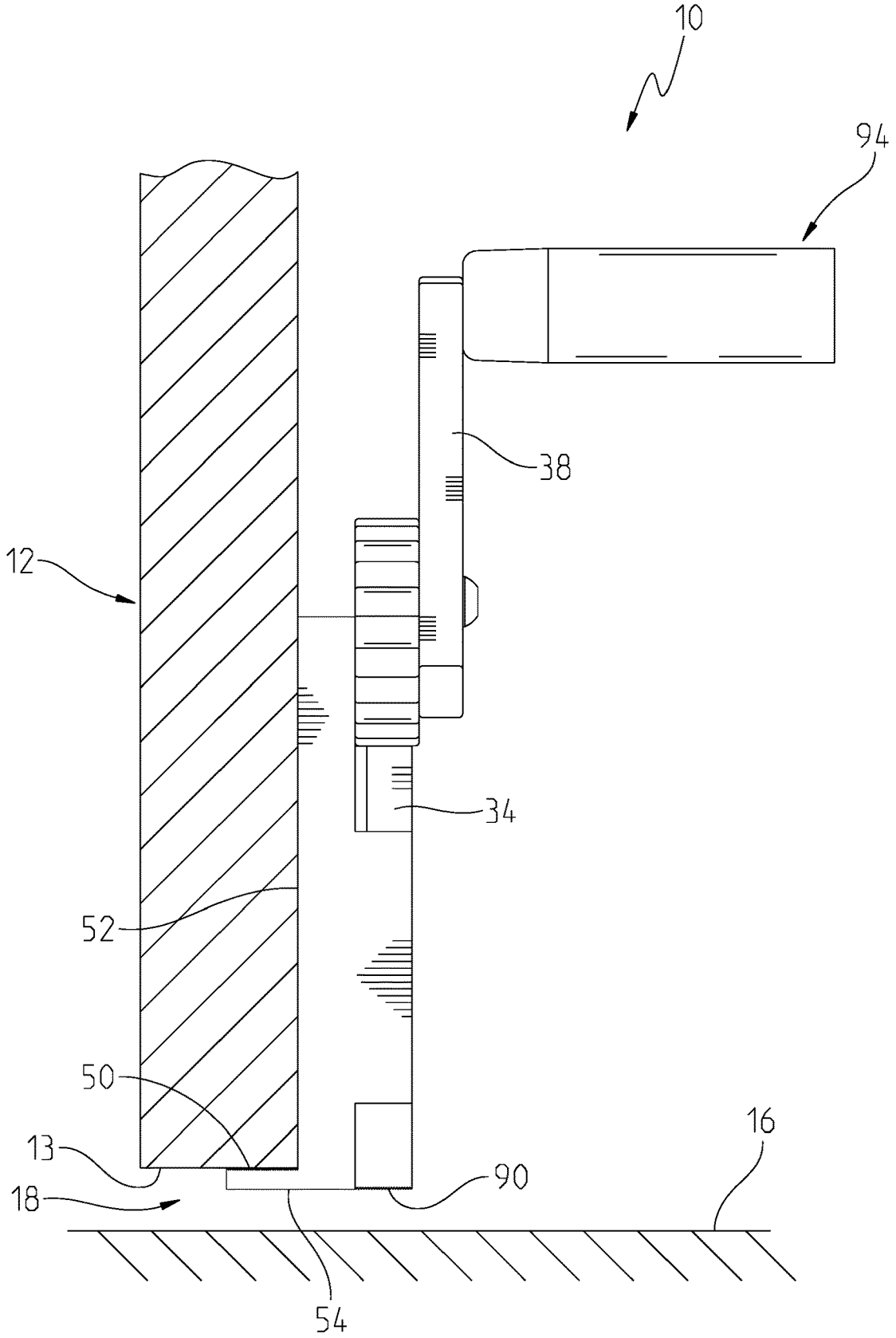
FIG. 3 is a side view of the device as installed on a door.
Figure 4:
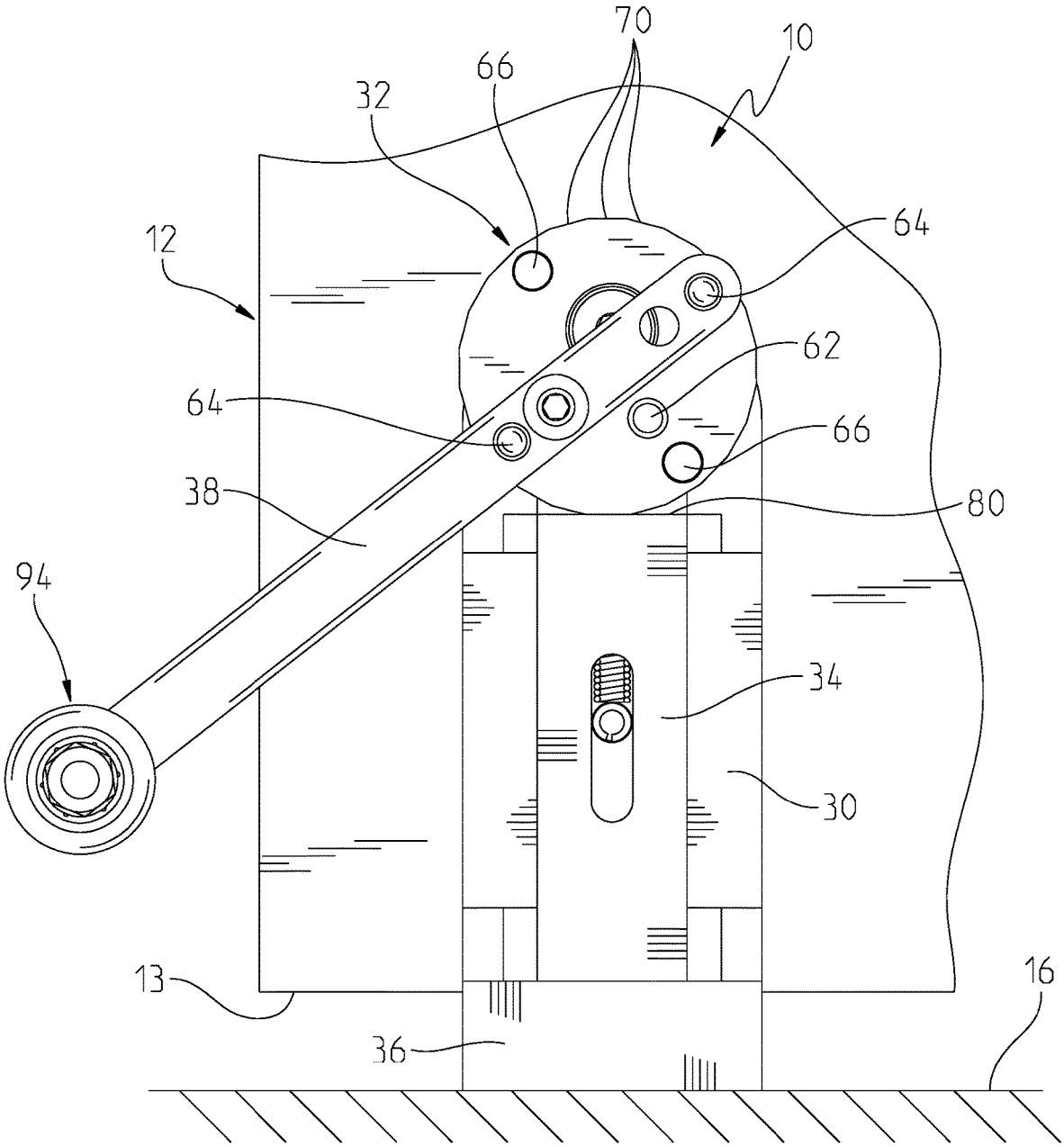
FIG. 4 is a front view of the device as installed on a door and in locked position.
Figure 7:
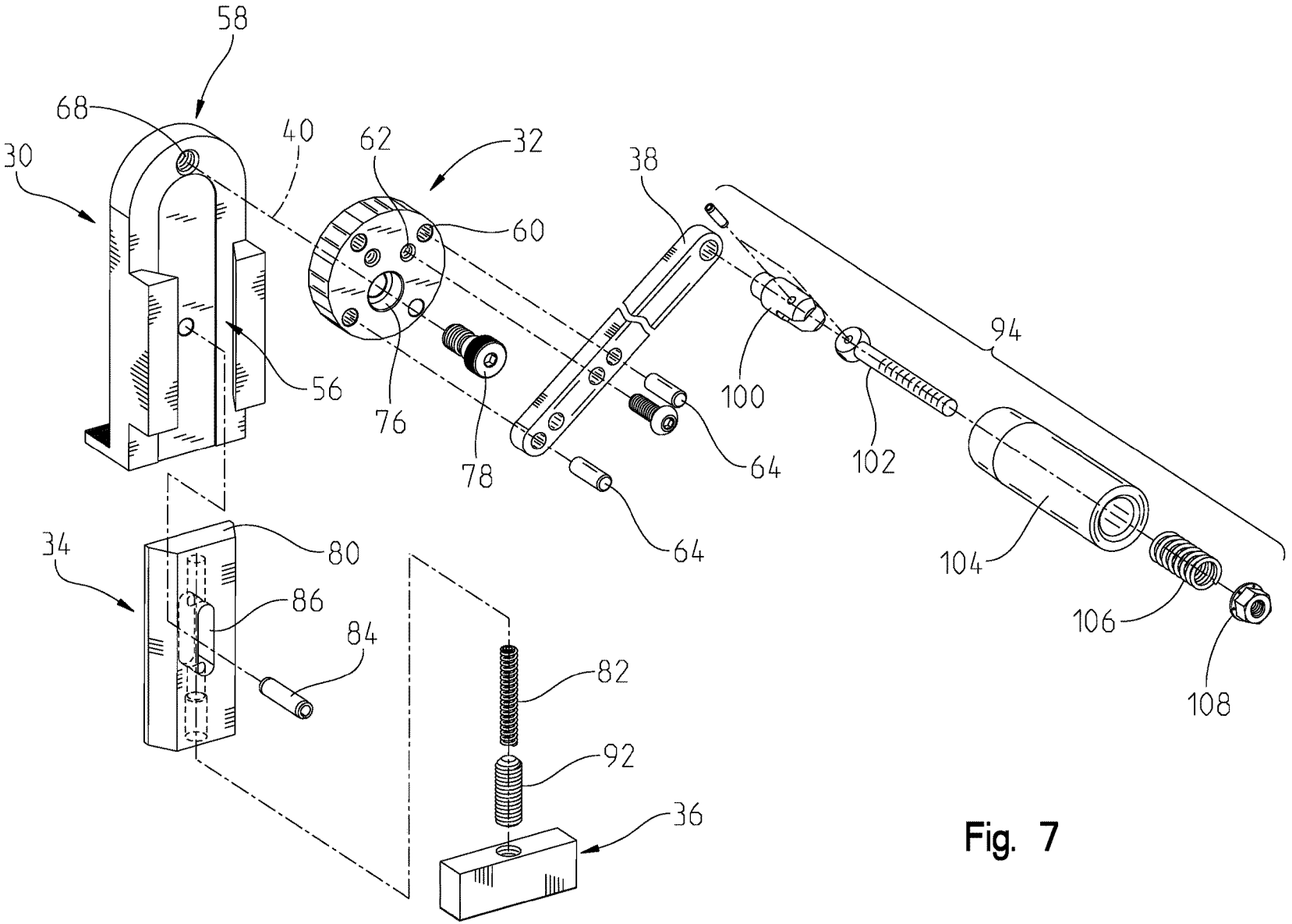
FIG. 7 is an isometric exploded view of the device.

As seen in FIG. 4, the eccentric cam 32 has a generally circular or round shape, but the circular shape does not have a truly circular outer surface. Instead, as seen in FIGS. 2 and 3, the eccentric cam 32 is made up of a plurality of planar surfaces 70. Together, the planar surfaces 70 form a geometric center. In the embodiment shown herein, the planar surfaces 70 are equally sized and spaced. The planar surfaces 70 meet at lateral edges 72 and each of the planar surfaces, with the lateral edges 72 being farther from the geometric center than the planar surfaces 70. The lateral edges 72 and planar surfaces 70 are parallel to the eccentric axis 40 which is centered about an offset hole 76. Overall, the lateral edges 72 are the outermost feature on the generally circular shape. The planar surfaces 70 are spaced differently from the offset hole 76. As can be seen in the FIG. 7, a fastener 78 threads into a hole 68 to secure the eccentric cam 32 to the body 30 to allow it to rotate about the eccentric axis 40. The eccentric cam 32 has mounting holes 62 for affixing the arm 38. As shown, the eccentric cam 32 has two sets of mounting holes 62 for the arm 38 to be affixed in different orientations. This allows the eccentric cam 32 to be rotated in either direction about the eccentric axis 40, depending on the orientation of the arm 38. This is also useful in the event there may be an outside obstruction that prevents the arm 38 from rotating. In the embodiment shown herein, the arm 38 includes alignment pins 64 that mate with sockets 66 in the eccentric cam 32.

Figure 5:
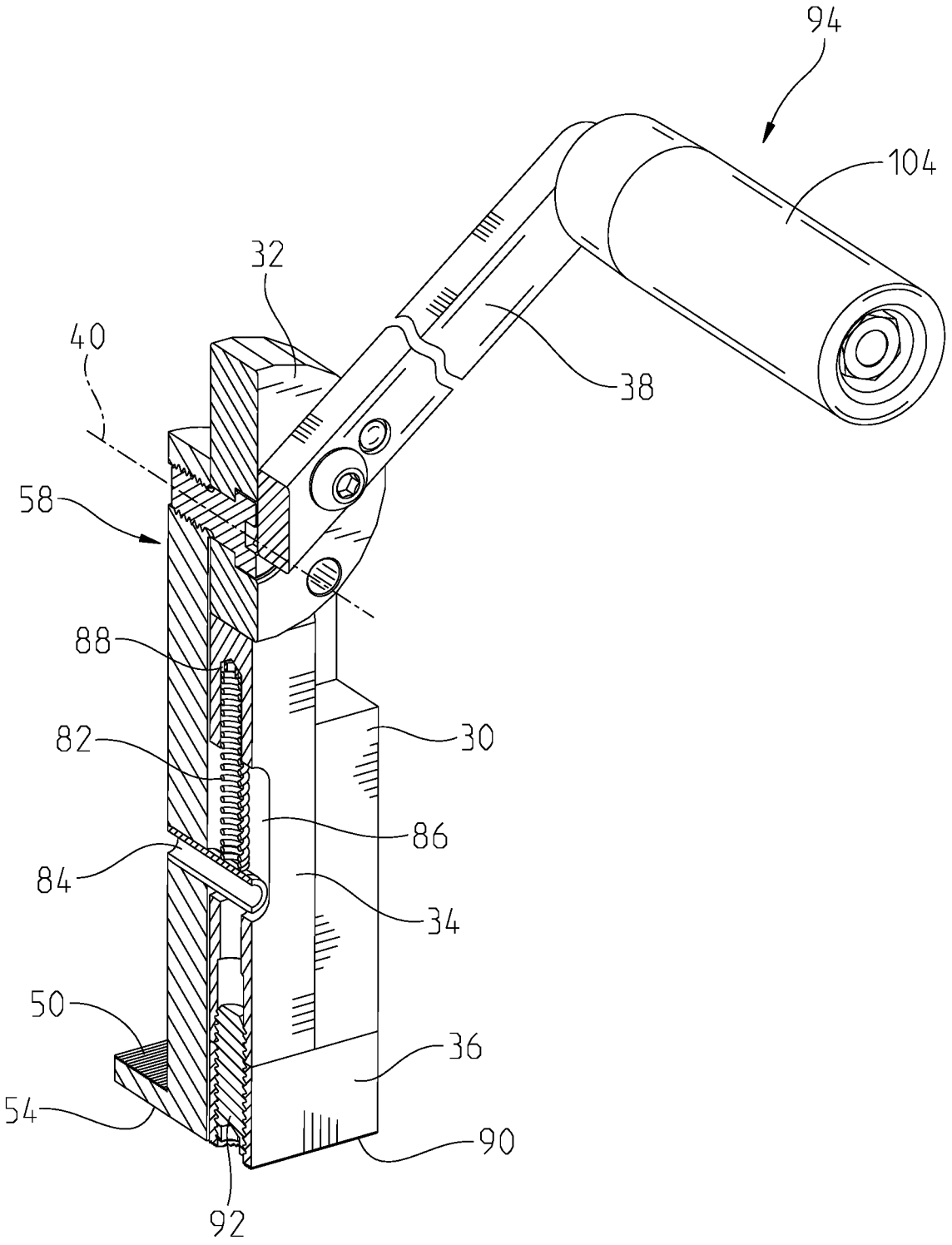
FIG. 5 is an isometric section view 5-5 of the device in FIG. 2.
Figure 6:
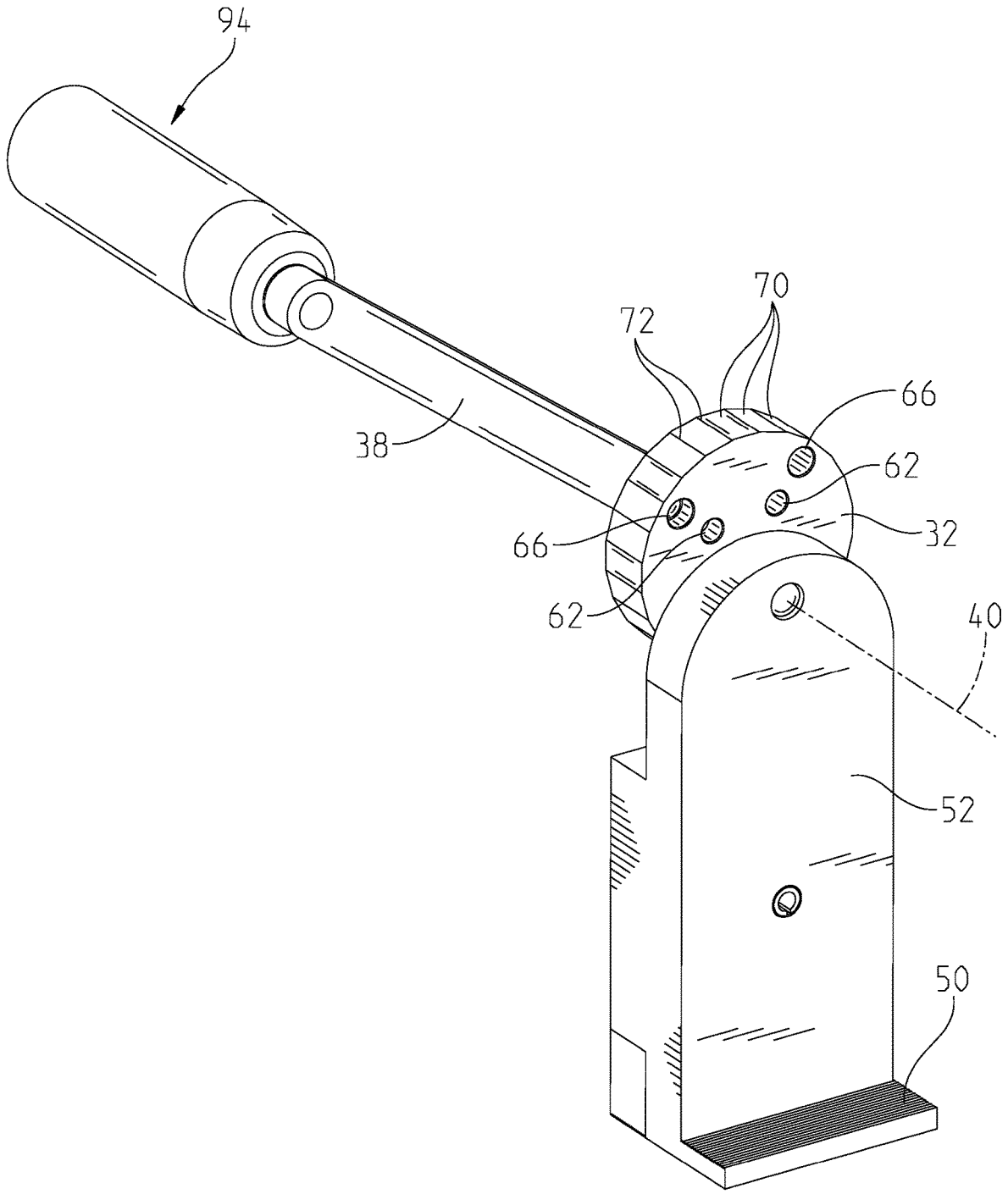
FIG. 6 is a rear isometric view of the device.

The sliding member 34 has a driven surface 80 that remains in biased contact with the eccentric cam 32 through a spring 82. The travel of the sliding member 34 is limited by a pin 84 that is affixed to the body 30 and resides in a slot 86 on the sliding member 34. The spring 82 is held between the sliding member 34 and pin 84 to provide the biasing force towards the eccentric cam 32. One end of the spring 82 is retained in a pocket 88, as shown in FIG. 5. The foot 36 is affixed to the sliding member 34 with a fastener 92, but it is contemplated that the foot 36 is integrated with the sliding member 34. The foot 36 has a foot surface 90 that may be knurled, textured, patterned, resilient, or otherwise treated to improve its ability to grip or prevent any sliding along the floor 16.

The arm 38 has a folding end 94 to make the locking device 10 more compact for storage. The folding end 94 is a spring-loaded revolving handle 104 to allow the user to move it between a folded position where the folding end 94 is parallel to the arm 38, shown in FIG. 8, and a use position where the folding end 94 is perpendicular to the arm 38. The handle 104 is held to a shaft 102 by a spring 106 and a nut 108. To move the folding end 94 to the folded position, the user pulls the handle 104 in the direction away from the arm 38 to clear the knuckle 100. To move it to the use position, the user simply folds the handle 104 to be perpendicular to the arm 38.

Because the offset hole 76 is not centered with respect to all of the planar surfaces 70, some of the planar surfaces 70 are closer to the offset hole 76 than others. As the eccentric cam 32 is rotated about eccentric axis 40, the sliding member 34 is moved from a retracted position (shown in FIG. 2), toward an extended position (shown in FIG. 4). Because the eccentric cam 32 has the radially-facing planar surfaces 70, the lateral edges 72 for each surface 70 acts as a "detent" when the corresponding planar surface 70 is in full contact with the driven surface. It is contemplated that the surfaces 70 are curved inwardly towards the center between the lateral edges 72. Without the edges, the "detent" would not function properly to retain the eccentric cam 32 in the position desired by the user. In the retracted position, the foot surface 90 is aligned with the bottom surface 54, as shown in FIG. 3. As the sliding member moves away from the retracted position, the foot surface 90 is proud of the bottom surface 54. In the extended position, the foot surface 90 is in biased contact with the floor 16, as shown in FIG. 4.

Figure 8:
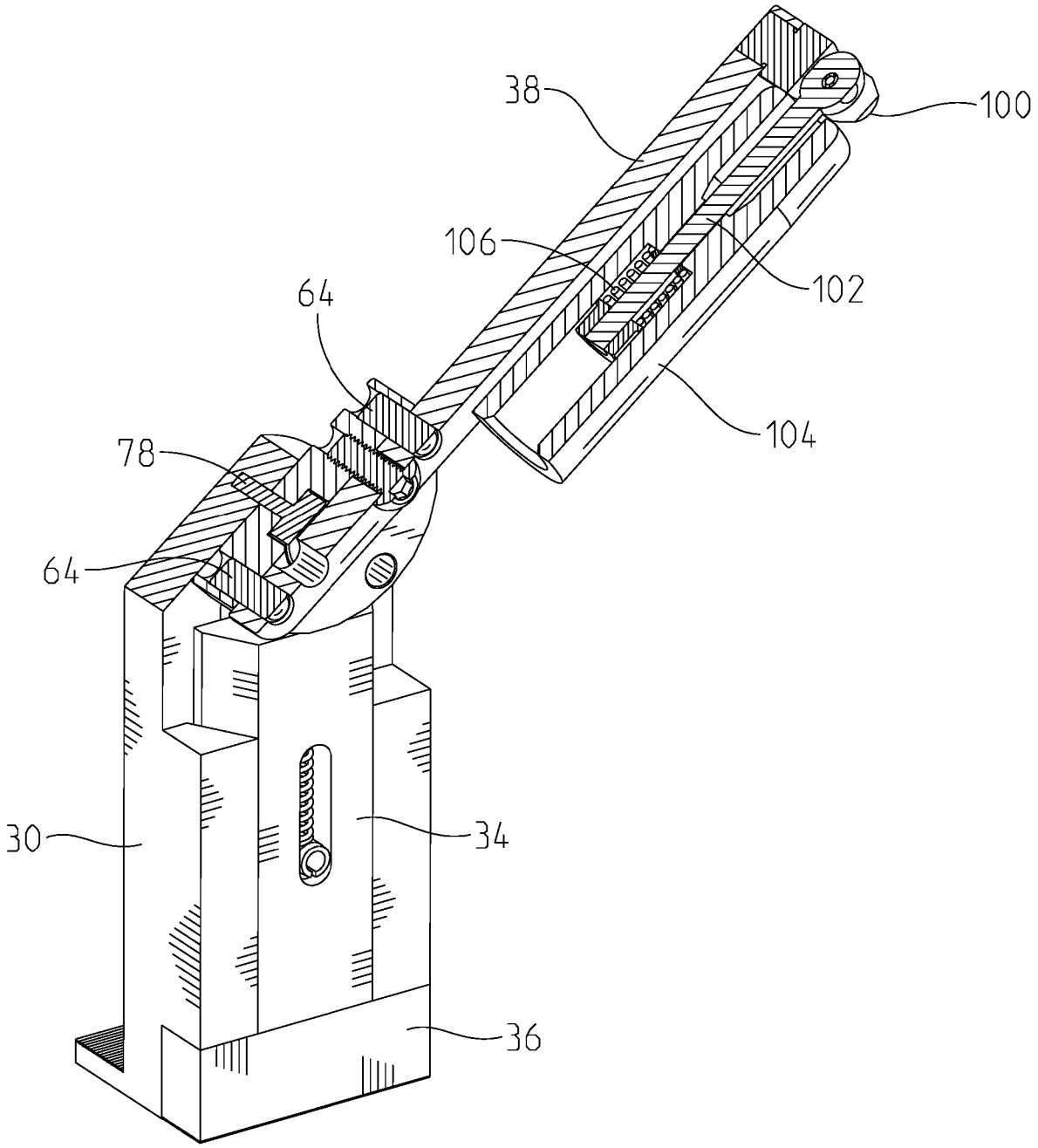
FIG. 8 is a section view 8-8 of the device in FIG. 2.

To use the locking device 10, the user closes the door 12 and places the device 10 as shown in FIG. 3 with the bottom ledge portion 50 located under the bottom edge 13 and the door-facing surface 52 in contact with the face of the door 12. The user then rotates the arm 38, moving the sliding member 34 from the retracted position towards the extended position. Based on the distance between the bottom edge 13 and floor 16, the foot surface 90 makes contact with the floor 16. The user continues moving the handle until the desired level of force against the floor 16 is achieved. The eccentricity multiplies the force from the arm 38 into downward pressure by the foot 36. The reaction force from the downward pressure is applied to the door 12 by the bottom ledge portion 50. This jams the door 12, making opening the door difficult. To release the locking device 10, the user rotates the arm 38 in the opposite direction, which retracts the sliding member 34 and foot 36. To fold the folding end 94 for storage, the user pulls on the handle portion until it clears a knuckle 100 and allows the shaft 102 to pivot and moves the handle 104 to the position as shown in FIG. 8.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A portable device for immobilizing a door, said door having a bottom edge facing a floor, said device comprising:

a body having a channel for receiving and retaining a sliding member, said body having a door-facing surface terminating at an overhanging ledge;

an eccentric cam having a geometric center, said eccentric cam being rotatably affixed to said body and rotatable about an eccentric axis that is offset from said geometric center, said eccentric cam having a plurality of surfaces defining a faceted perimeter thereof, said surfaces bounded by lateral edges, said lateral edges being radially farther from said geometric center than a portion of one of said surface located between adjacent lateral edges said surfaces located between adjacent said lateral edges being planar surfaces;

said sliding member retained in said channel and slidable between an extended position and a retracted position in a direction perpendicular to said eccentric axis and parallel to said door-facing surface, said sliding member having a driven surface for facing and contacting said eccentric cam, said driven surface contacting one of said surface located between said adjacent lateral edges, said sliding member having a foot on an end opposite said driven surface;

an arm affixed to said eccentric cam to rotate said eccentric cam about said eccentric axis;

a spring biasing said driven surface of said sliding member towards said faceted perimeter of said eccentric cam; and when said eccentric cam is rotated said lateral edges acting as plurality of detents, and, said sliding member moves between said extended position and said retracted position; wherein said eccentric cam includes three or more of said planar surfaces.

2. The device in claim 1, wherein said sliding member has a slot, said sliding member is retained in said channel by a pin extending into said slot.

3. The device in claim 2, wherein said spring is located between said pin and a pocket in said sliding member.

4. The device in claim 1, wherein said body has a bottom surface, said foot having a foot surface, said foot surface is proud of said bottom surface when said sliding member is away from said retracted position.

5. A portable device for immobilizing a door, said door having a bottom edge facing a floor, said device comprising:

a body receiving and retaining a sliding member, said body having a door-facing surface and an overhanging ledge;

an eccentric cam having a geometric center, said eccentric cam being rotatably affixed to said body and rotatable about an eccentric axis that is offset from said geometric center, said eccentric cam having a plurality of surfaces defining a faceted perimeter thereof, said surfaces bounded by adjacent lateral edges and being planar for an entire distance between said adjacent lateral edges, and said lateral edges being radially farther from said geometric center than a portion of said one of surface located between said adjacent lateral edges;

said sliding member slidable between an extended position and a retracted position, said sliding member having a driven surface for facing and contacting said eccentric cam, said sliding member having a foot portion on an end opposite said driven surface;

an arm affixed to said eccentric cam to rotate said eccentric cam about said eccentric axis;

said sliding member biased towards said faceted perimeter of said eccentric cam; and when said eccentric cam is rotated, said sliding member moves between said extended position and said retracted position.

6. The device in claim 5, wherein said sliding member has a slot, said sliding member is retained in a channel by a pin extending into said slot.

7. The device in claim 6, wherein said sliding member is slidable in a direction perpendicular to said eccentric axis and parallel to said door-facing surface.

8. The device in claim 5, further comprising a spring biasing said sliding member towards said eccentric cam.

9. The device in claim 8, wherein said spring is located between a pin and a pocket in said sliding member.

10. The device in claim 5, wherein said body has a bottom surface, said foot having a foot surface, said foot surface is aligned with said bottom surface in when said sliding member is in said retracted position.

11. The device in claim 5, wherein said sliding member is retained to said body by a channel on said body.

12. A device for immobilizing a door, said door having a bottom edge facing a floor, said device comprising:

a body having a channel for receiving and retaining a sliding member, said body having a door-facing surface terminating at an overhanging ledge;

an eccentric cam rotatably affixed to said body and rotatable about an eccentric axis, said eccentric cam having a faceted perimeter of adjacent surfaces defined by adjacent lateral edges and said surfaces being planar between said adjacent lateral edges defining said surfaces, said eccentric cam having a geometric center, said eccentric axis offset from said geometric center, each of said adjacent surfaces are parallel to said eccentric axis;

an arm affixed to said eccentric cam;

said sliding member retained in said channel and slidable between an extended position and a retracted position in a direction perpendicular to said eccentric axis, said sliding member having a driven surface facing said eccentric cam, said sliding member having a foot on an end opposite said driven surface;

an arm affixed to said eccentric cam to rotate said eccentric cam about said eccentric axis;

a spring biasing said driven surface of said sliding member towards said faceted perimeter of said eccentric cam; and when said eccentric cam is rotated, said sliding member moves between said extended position and said retracted position; wherein said eccentric cam includes three or more of said being planar between said adjacent lateral edges.

13. The device in claim 12, wherein said sliding member has a slot, said sliding member is retained in said channel by a pin.

14. The device in claim 13, wherein said spring is located between said pin and a pocket in said sliding member.

15. The device in claim 12, wherein said body has a bottom surface, said foot having a foot surface, said foot surface is aligned with said bottom surface in when said sliding member is in said retracted position.

* * * * *